United States Patent [19]

Dewing

[11] Patent Number: 4,790,917

[45] Date of Patent: Dec. 13, 1988

[54] REFINING OF LITHIUM-CONTAINING ALUMINUM SCRAP

[75] Inventor: Ernest W. Dewing, Kingston, Canada

[73] Assignee: Alcan International Limited, Montreal, Canada

[21] Appl. No.: 117,037

[22] Filed: Nov. 4, 1987

[30] Foreign Application Priority Data

Nov. 7, 1986 [CA] Canada ..... 522510

[51] Int. Cl.[4] ..... C25C 3/06

[52] U.S. Cl. ..... 204/140

[58] Field of Search ..... 204/140, 130, 68, 69

[56] References Cited

U.S. PATENT DOCUMENTS

| | | | |
|---|---|---|---|
| 2,787,592 | 4/1957 | Burkhardt | 204/140 |
| 4,521,284 | 6/1985 | Tanabe et al. | 204/71 |
| 4,533,442 | 8/1985 | Neelameggham et al. | 204/68 |

OTHER PUBLICATIONS

Chemical Abstracts, vol. 99, No. 3, 18th Jul. 1983, p. 542, Abstract No. 221017g.

Miscibility of Lithium With Lithium Chloride and Lithium Chloride–Potassium Chloride Eutectic Mixture, Nakajima et al., Bulletin of the Chemical Society of Japan, vol. 47(8), 2071–2072 (1974).

*Primary Examiner*—T. M. Tufariello

*Attorney, Agent, or Firm*—Cooper & Dunham

[57] ABSTRACT

A method of refining lithium-containing aluminum scrap metal. An electrolytic cell is formed using molten scrap as the anode, lithium or Al-Li as the cathode and a chloride-based lithium electrolyte. The cell is operated at a temperature of about 700° C. and the lithium is transferred from the scrap to the cathode. The depletion of lithium in the scrap is signalled by an abrupt rise in voltage of the cell. The remaining scrap at the anode can be used in the same way as conventional aluminum scrap and the pure Li or Al-Li alloy formed at the cathode can be used as new material for the Al-Li alloy market.

11 Claims, 3 Drawing Sheets

REFINING OF LITHIUM-CONTAINING ALUMINUM SCRAP

BACKGROUND OF THE INVENTION

I. Field of the Invention

This invention relates to the refining of lithium-containing aluminum scrap.

II. Description of the Prior Art

Aluminum-lithium alloys are used in the aircraft industry and for other specialized markets and large amounts of scrap are produced during the manufacture of specialized parts from the alloys. Recycling of the scrap is economically desirable but these particular alloys present difficult problems when they enter the scrap market. The alloys cannot merely be re-melted and used again for the same purposes because they have picked up iron and other impurities which adversely affect the metallurgical properties of the alloys. However, the alloys cannot be used with other aluminum scrap because the lithium is harmful to more conventional aluminum alloys, for example the casting alloys which are the normal end-product of aluminum scrap. Moreover, lithium is expensive and should be recovered, if possible.

Lithium may be removed from Al-Li alloys by chlorination to convert all of the lithium to LiCl, but this procedure is wasteful of energy and it involves the use of chlorine on a massive scale, which is environmentally hazardous.

Another possible way of removing lithium from the scrap is by electrolysis using molten scrap as an anode and a lithium chloride based electrolyte. However, it is known that lithium is quite soluble in lithium chloride at the normal cell operating temperatures of about 700° C. Nakajima et al in "Miscibility of Lithium with Lithium Chloride and Lithium Chloride-Potassium Chloride Eutectic Mixture", Bulletin of the Chemical Society of Japan, Vol. 47(8), 2071–2072 [1974], show that the solubility of lithium is about 0.8 mole % Li at 700° C. (0.27 equivalents Li/litre). Such solubility would be expected to dramatically reduce the cell current efficiency. For comparison, the solubility of aluminum in the electrolyte of an aluminum reduction cell is about 0.07 equivalents/litre and this gives rise to a 10% reduction in current efficiency. Lithium, being four times as soluble, could be expected to give a 40% reduction, which would be economically unattractive.

This potential problem would be expected to be particularly pronounced when pure lithium is collected at the cathode. The problem could perhaps be alleviated by forming an Li-Al alloy at the cathode, which would be expected to reduce the activity of lithium to the order of 0.03, and consequently would be expected to reduce the lithium solubility proportionally. However, even in this case, there would be a problem in determining when the optimum removal of lithium from the anode had taken place. This is important because lithium scrap is by its nature of inconsistent composition, so the amount of Li is not known in advance. If electrolysis of aluminum from the anode takes place, aluminum chloride is produced in the electrolyte and this is undesirable because aluminum chloride is volatile. Moreover, there is no economic advantage in transferring aluminum from the anode to the cathode.

For these reasons it has not been apparent that refining to pure lithium is practical at all nor that refining to Al-Li alloy is effectively controllable.

SUMMARY OF THE INVENTION

Accordingly, an object of the present invention is to provide methods of refining lithium-containing aluminum scrap which are capable of being operated in an economically feasible manner on an industrial scale.

The present invention is based on the unexpected finding that the scrap can be refined by electrolysis to produce pure lithium without the anticipated low current efficiency. Moreover, it has also been found that the optimum depletion of lithium from the scrap can be determined by monitoring the cell voltage.

Thus, according to one aspect of the invention there is provided a method of refining lithium-containing aluminum scrap to produce substantially pure Li and lithium-depleted scrap, which method comprises electrolyzing the lithium in an electrolytic cell employing said scrap in molten form as an anode, molten lithium as a cathode and a lithium chloride-based electrolyte, and collecting lithium from the cathode and lithium-depleted scrap from the anode.

According to another aspect of the invention there is provided a method of refining lithium-containing aluminum scrap, which comprises electrolyzing the lithium in an electrolytic cell employing said scrap in molten form as an anode, lithium or Li-Al alloy in molten form as a cathode and a lithium chloride-based electrolyte, monitoring the cell voltage as the electrolysis proceeds and terminating the electrolysis approximately when an abrupt rise in voltage corresponding to a depletion of lithium at the anode is observed.

DETAILED DESCRIPTION OF THE INVENTION

Figure 1:
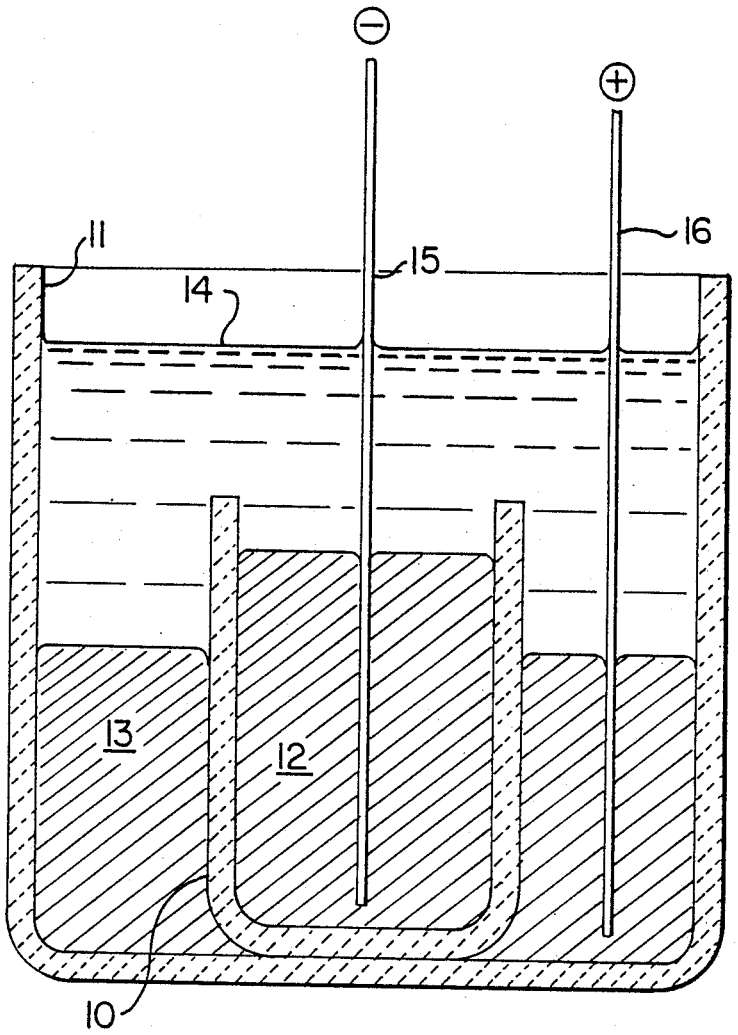
FIG. 1 is a cross-section of an electrolytic cell of the type used in Example 1.

By "substantially pure lithium" we mean lithium that is essentially free of aluminum but which may contain addition elements, such as magnesium, which are also ingredients of the commercial alloys into which the lithium will be incorporated.

The lithium-depleted scrap remaining at the anode may be used as conventional aluminum alloy scrap and the lithium material (i.e. either pure Li or an Al-Li alloy) recovered at the cathode may be used for the production of new Al-Li alloys.

Because of the extreme reactiveness of pure lithium, particularly when it is in molten form, care should be taken to protect the metal from unwanted reactions, such as oxidion. This can be achieved by handling the lithium in an inert environment. Indeed the electrolysis may be carried out in an inert atmosphere (e.g. of a noble gas such as argon), if desired.

By "anode" and "cathode" we mean the materials forming the surfaces at which the electron transfer takes place during electrolysis, i.e. the molten metals. Solid elements used to contain and conduct current to the molten metals are referred to as anode and cathode structures.

If pure lithium is to be produced, the cathode will be molten lithium formed immediately electrolysis commences and the cathode structure may be an inert metal such as mild steel.

If an Al-Li alloy is to be formed, molten Al-Li alloy acts as the cathode and the cathode structure may consist of a container of an inert refractory material, such as alumina, together with electrical conductors made from titanium diboride or other refractory hard metal composites. This is also a satisfactory structure for the anode in either case (i.e. Li or Al-Li production).

As stated above, for Al-Li production the cathode is an Al-Li alloy. This can be produced by providing molten aluminum in the cathode sturcture prior to electrolysis. The molten aluminum may be substantially pure or may contain elements which are desirable in the recovered Al-Li alloy.

When the method is operated on the laboratory scale, tungsten may be used for electrical conductors, although they are not long lasting.

It has been found that certain heat-resistant materials, e.g. graphite, become brittle and swell when exposed to lithium during the electrolysis, so such materials should be avoided in the parts of the cell which contact the molten metal. Consequently, the cell should be made at least in part from a material which is substantially inert to lithium in the conditions encountered, and alumina is satisfactory.

The preferred electrolyte is LiCl, but the presence of other halides, e.g. lithium fluoride or potassium chloride, can be tolerated. Such electrolytes are referred to hereinafter as lithium chloride-based electrolytes.

The method of the present invention is operated on a batchwise basis. As noted above, it is desirable to continue the electrolysis until substantially all of the lithium has been depleted from the scrap but to terminate the electrolysis before aluminum is electrolysed. This can be achieved by monitoring the cell voltage (preferably the open cell voltage). A large large voltage increase (in the order of 0.5 volt or more) takes place when the lithium has been depleted. Consequently, the electrolysis can be stopped approximately when the voltage change occurs and the danger of electrolysing Al can be avoided.

Many Al-Li scrap materials contain a small percentage of magnesium and small amounts of other elements. For example a typical composition is as follows:

| Element | % by weight |
|---|---|
| Li | 0.5–2.8 (Typically 2.5) |
| Mg | 0.4–1.0 (Typically 0.6) |
| Cu | 1.0–1.5 |
| Zr | 0–0.2 |
| Mn | 0–0.5 |
| Ni | 0–0.5 |
| Cr | 0–0.5 |
| Al | Balance |

Rather than being harmful to the method, the presence of the Mg is beneficial. Lithium, being the highest element in the electrochemical series, is inevitably the first element to electrolyze. Magnesium, which is higher in the electrochemical series than aluminum, electrolyzes after the Li has been depleted and before electrolysis of the Al commences. Thus, the Mg acts as a kind of buffer. It allows the electrolysis to be continued until substantially all of the Li has been removed from the scrap without risking the electrolysis of aluminum. The presence of Mg in the cathode metal is not harmful because this element is anyway a desirable constituent of Al-Li alloys.

A suitable way of conducting the electrolysis would be to continue passing current after the first large increase in cell voltage (signifying Li depletion) for a time suitable to electrolyse approximately half of the magnesium present in the scrap.

When Mg (or other buffer element) is present in the scrap, the electrolysis may be continued until the remaining Li in the scrap is about 100 ppm or less. When no buffer element is present, the electrolysis may have to leave a slightly higher Li content in the scrap to be sure of avoiding $AlCl_3$ formation.

Most Al-Li alloys in use today contain Mg but specialized Al-Li alloys may contain no Mg or other buffer elements. In this case, a buffer element, such as Mg, may be added to the molten scrap at the anode before electrolysis commences. This will allow the amount of Li in the scrap to be reduced to the desired low level.

The cell should be operated at temperatures which maintain the anode, cathode and electrolyte in a molten condition. Normally, this requires a temperature of about 700° C. Higher temperatures may be employed but there is no advantage and the method becomes more wasteful of energy.

The anode scrap and cathode aluminum (when used) are normally melted before being added to the cell. However, in a large scale cell, the solid metal may be added when there is enough heat available to melt the metal as electrolysis proceeds.

The current density within the cell is normally in the range of about 0.1 to 10 amps/cm$^2$.

As will become clear from the following Examples, the method of the invention is capable of operating at current efficiencies of the order of 90% when pure Li is formed at the cathode and of the order of 95% when Al-Li alloys are formed at the cathode. Clearly, the anticipated efficiency reduction when making pure Li does not, for some unexplained reason, take place.

The invention is described in more detail with reference to the following Examples. The Examples are provided for illustration only and should not be construed as limiting the scope of the invention in any way.

EXAMPLE 1

Two test runs (Runs 1 and 2) were carried out in a cell as shown in FIG. 1. This consisted of two alumina crucibles 10 and 11, the smaller one 10 being located within the larger one 11. Pure aluminum 12 in molten form was introduced into the inner crucible 10 and Al-Li scrap 13 in molten form was introduced into the larger crucible 11 to occupy the annular space between the inner surface of the larger crucible and the outer surface of the smaller crucible. The surfaces of the pure aluminum 12 and the Al-Li scrap 13 were both covered by a molten LiCl electrolyte 14. Tungsten leads 15 and 16 were used to feed electrical current to the pure aluminum 12 and the Al-Li scrap 13. The cell was located in a closed bottom, stainless steel tube (not shown) flushed with argon. A resistance heated furnace controlled by a thermocouple attached to the outside of the steel tube was used to maintain the cell at a temperature of 700° C.±10–20° C.

The two runs differed in the quantity of alloy employed and hence the time required for electrolysis and the final concentration of the Li in the initially pure aluminum.

In each test run the current was nominally 3A and was measured 50 times per minute with a 1Ω resistor and a voltmeter, and was integrated to give the number of coulombs.

In the first test run the current was interrupted by hand from time to time to obtain the zero current potential and the working voltage of the cell was measured on a minute by minute basis.

In the second test run the cell voltage was measured once per minute, and then the current was reduced nominally to zero. The next current reading was thus very low, the cell voltage was measured again, and then the current was restored to its original value. A straight-line extrapolation gave the open-circuit voltage.

Tables 1 and 2 below show the chemical analyses and the operating parameters of the cell.

TABLE 1

| | CHEMICAL ANALYSES | | | | | | | | | |
|---|---|---|---|---|---|---|---|---|---|---|
| | Li (%) | Cu (%) | Fe (%) | Mg (%) | Si (%) | Zn (%) | Zr (%) | Ca (ppm) | Na (ppm) | K (ppm) |
| Starting Alloy | 2.27 | 1.30 | 0.029 | 0.65 | 0.018 | | 0.17 | 16 | 1 | <2 |
| Final Compositions | | | | | | | | | | |
| Run 1 - Inner | 2.32 | 0.001 | <0.001 | <0.001 | 0.003 | <0.001 | <0.001 | 10 | <2 | <2 |
| Run 1 - Outer | 0.007 | 1.77 | 0.041 | 0.377 | 0.029 | 0.017 | 0.123 | <10 | <2 | <2 |
| Run 2 - Inner | 3.11 | 0.001 | <0.001 | 0.003 | 0.001 | <0.001 | <0.001 | 30 | <2 | <2 |
| Run 2 - Outer | 0.010 | 1.72 | 0.039 | 0.486 | 0.027 | 0.017 | 0.119 | <10 | <2 | <2 |

TABLE 2

| | OPERATING PARAMETERS | | | | | | | |
|---|---|---|---|---|---|---|---|---|
| | Duration (min) | Total Coulombs | Initial Alloy (g) | Initial S.P.* (g) | Initial Li (g) | Final Li (g) | Cathode C.E.** (%) | Anode C.E.** (%) |
| Run 1 | 126 | 22867 | 65.35 | 65.78 | 1.483 | 1.562 | 95.0 | 96.1 |
| Run 2 | 177 | 32049 | 94.29 | 65.69 | 2.140 | 2.109 | 91.4 | 96.3 |

*Super Purity
**Current Efficiency

Figure 2:
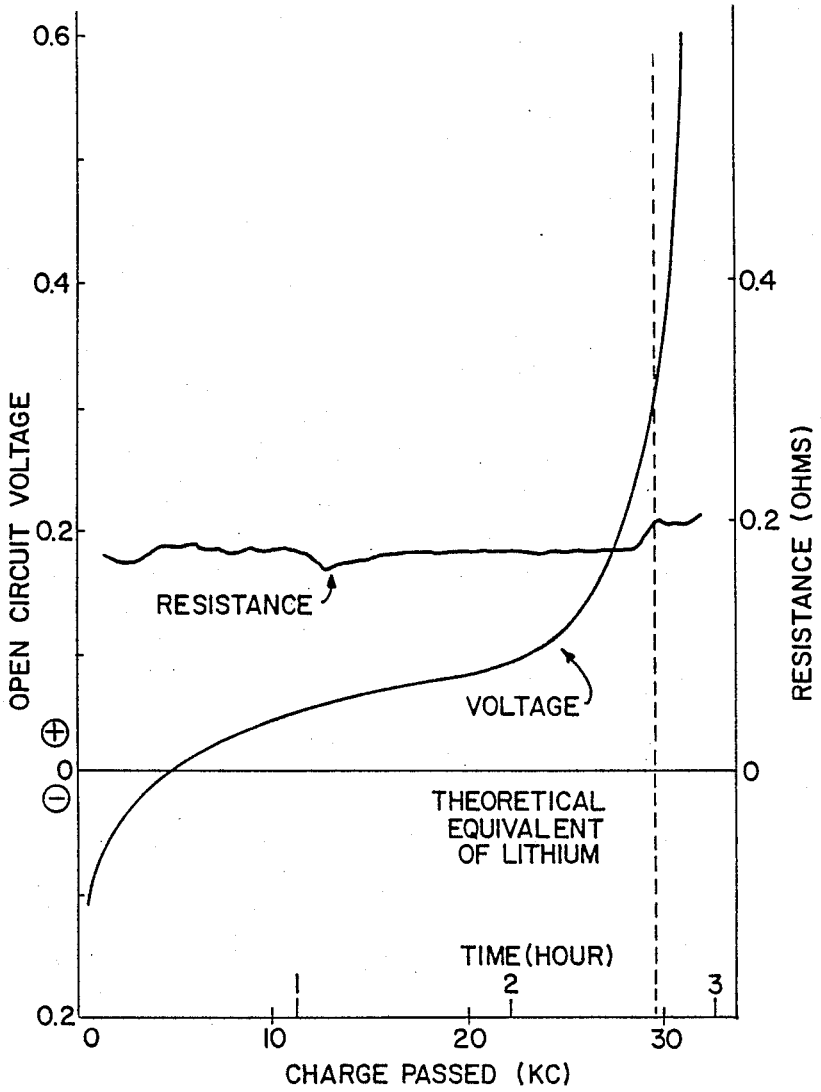
FIG. 2 is a graph showing the voltage and resistance of a cell operated according to Example 1.

The open-circuit voltage and cell resistance for Run 2 are shown in FIG. 2 as a function of the number of coulombs passed. The theoretical number of coulombs corresponding to the Li content of the Al-Li scrap is indicated. It will be seen that there is an abrupt rise of voltage at approximately this position corresponding to the switch from the electrolysis of Li to the electrolysis of Mg and there is also a minor rise in resistance (about 15%) which may be associated with the presence of $MgCl_2$ in the electrolyte.

The behaviour of Run 1 was very similar with again a sharp rise in voltage at the theoretical time for Li depletion.

At the end of each run, the contents of the crucibles were poured onto an Al tray where they solidified and then the metals were removed for analysis.

The figures in Table 1 show that no significant transfer of impurities had occurred. Indeed, even Mg did not show up in the product, although it started to be depleted at the anode. This may be because a dense $MgCl_2$-LiCl melt formed near the anode requires time to migrate to the cathode.

The current efficiencies given in Table 2 are close to 100%.

Note that in both of these test runs the electrolysis was successfully stopped in the buffer zone provided by the magnesium, i.e. Li removal was essentially complete (99.7% and 99.6% respectively) while there was a lot of magnesium left (58% and 75% respectively), so that Al electrolysis had not started.

EXAMPLE 2

Figure 3:
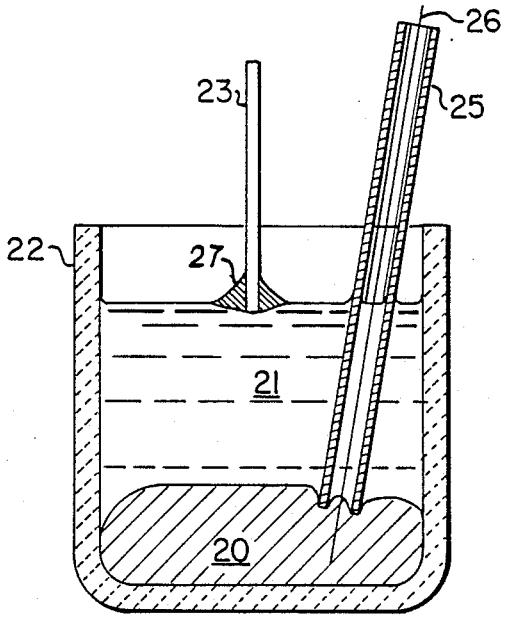
FIG. 3 is a cross-section of a cell in which pure lithium is produced as in Example 2.

A test run was made in which Li was the cathode product. The apparatus is shown in FIG. 3. An alumina crucible 22 held 21.37 g of alloy of the same composition as in Example 1, and 24 g LiCl. The anode lead 26 was a tungsten rod protected by an alumina sheath 25. A mild-steel cathode 23 rod extended down into the LiCl, and Li 27 was formed electrolytically. The furnace tube was flushed with argon.

The measuring procedure was as described in Test Run 2 of Example 1. The sharp rise in voltage occurred when 7230 coulombs had been passed, and the run was terminated at 7712 coulombs. Analysis of the residual scrap showed 0.011% Li and 0.503% Mg. Calculation of the theoretical number of coulombs required gave 6968, for a current efficiency of 90.3%.

Although the presence of metallic lithium at the cathode was verified after the run, it was not possible to recover it quantitatively to obtain a verification of the current efficiency.

EXAMPLE 3

In this case electrolysis was deliberately taken past the point envisaged in the invention to illustrate the concept of the buffer zone provided by the magnesium. An alumina crucible was used, divided into two compartments by a slice cut from an alumina brick. Other than this different geometry, the test was similar to that described in Test Run 2 of Example 1.

Figure 4:
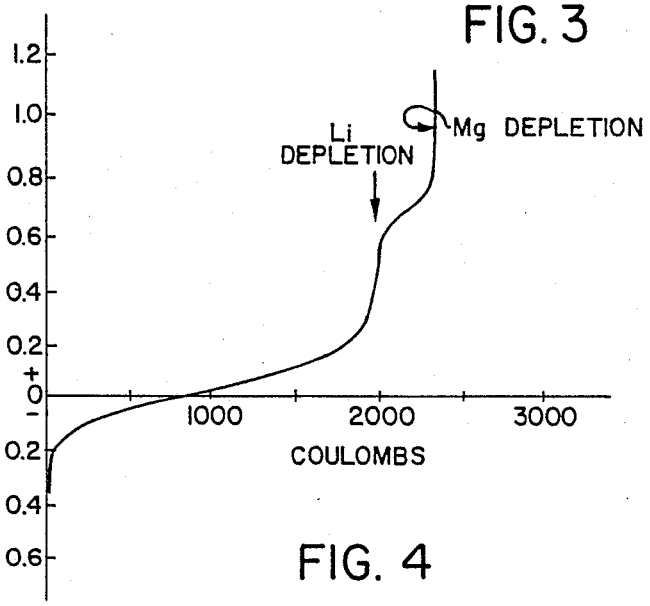
FIG. 4 is a graph of open circuit voltage against coulombs passed derived from Example 3.

FIG. 4 shows the plot of open-circuit voltage against coulombs passed. The voltage rises associated with Li depletion and Mg depletion are very clearly seen, and there is sufficient time between them, in this case 19 minutes, that it would have been easy to stop the electrolysis within the buffer zone.

What we claim is:

1. A method of refining lithium-containing aluminum scrap to produce substantially pure Li and lithium-depleted scrap, which method comprises electrolyzing the lithium in an electrolytic cell employing said scrap in molten form as an anode, molten lithium as a cathode and a lithium chloride-based electrolyte, and collecting lithium from the cathode and lithium-depleted scrap from the anode.

2. A method according to claim 1 wherein the cell is maintained at a temperature of at least about 700° C. during the electrolysis.

3. A method according to claim 1 wherein the voltage of the cell is monitored during the electrolysis and the electrolysis is terminated approximately when there is an abrupt rise in voltage corresponding to the depletion of lithium at the anode.

4. A method according to claim 1, wherein the scrap contains an additional element located in the electrochemical series between lithium and aluminum, wherein the voltage of the cell is monitored during the electrolysis and wherein the elecrolysis is terminated after an abrupt rise in voltage corresponding to the depletion of lithium at the anode, but before a further rise in voltage corresponding to the depletion of said additional element at the anode.

5. A method according to claim 4 wherein the additional element is magnesium.

6. A method according to claim 1, wherein the scrap has the following composition:

| Element | % by weight |
|---|---|
| Li | 0.5–2.8 |
| Mg | 0.4–1.0 |

-continued

| Element | % by weight |
|---|---|
| Cu | 1.0–1.5 |
| Zr | 0–0.2 |
| Mn | 0–0.5 |
| Ni | 0–0.5 |
| Cr | 0–0.5 |
| Al | Balance |

7. A method of refining lithium-containing aluminum scrap, which comprises electrolyzing the lithium in an electrolytic cell employing said scrap in molten form as an anode, lithium or Li-Al alloy in molten form as a cathode and a lithium chloride-based electrolyte, monitoring the cell voltage as the electrolysis proceeds and terminating the electrolysis approximately when an abrupt rise in voltage corresponding to a depletion of lithium at the anode is observed.

8. A method according to claim 7 wherein the cell is maintained at a temperature of at least about 700° C. during the electrolysis.

9. A method according to claim 7 wherein the scrap contains an additional element located in the electrochemical series between lithium and aluminum, and the electrolysis is terminated after said abrupt rise in voltage but before a further rise in voltage corresponding to the depletion of said additional element at the anode.

10. A method according to claim 9 wherein said additional element is magnesium.

11. A method according to claim 7, wherein the scrap has the following composition:

* * * * *

UNITED STATES PATENT AND TRADEMARK OFFICE

CERTIFICATE OF CORRECTION

PATENT NO. : 4,790,917

DATED : December 13, 1988

INVENTOR(S) : Ernest W. Dewing

It is certified that error appears in the above-identified patent and that said Letters Patent is hereby corrected as shown below:

Column 8, following line 31 (after "composition:"), insert:

--

| Element | % by weight |
|---|---|
| Li | 0.5 - 2.8 |
| Mg | 0.4 - 1.0 |
| Cu | 1.0 - 1.5 |
| Zr | 0 - 0.2 |
| Mn | 0 - 0.5 |
| Ni | 0 - 0.5 |
| Cr | 0 - 0.5 |
| Al | Balance. |

--

Signed and Sealed this

Fourth Day of February, 1992

*Attest:*

*Attesting Officer*

HARRY F. MANBECK, JR.

*Commissioner of Patents and Trademarks*